US005967319A

United States Patent [19]

White, Jr.

[11] Patent Number: 5,967,319

[45] Date of Patent: Oct. 19, 1999

[54] BOTTLE CARRIER

[76] Inventor: George H. White, Jr., 14 Birdie La., Palm Harbor, Fla. 34683

[21] Appl. No.: 09/229,803

[22] Filed: Jan. 13, 1999

Related U.S. Application Data

[63] Continuation-in-part of application No. 09/049,574, Mar. 27, 1998, abandoned.

[51] Int. Cl.[6] ..... B65D 65/00

[52] U.S. Cl. ..... 206/428; 206/200; 206/435

[58] Field of Search ..... 206/141, 142, 206/147, 170, 168, 200, 427, 428, 431, 813, 435; 229/87.04, 89, 117.19, 117.23, 117.26

[56] References Cited

U.S. PATENT DOCUMENTS

| | | | |
|---|---|---|---|
| Re. 25,949 | 12/1965 | Andre . | |
| 2,361,926 | 11/1944 | Brogden . | |
| 2,508,909 | 5/1950 | Evans et al. . | |
| 2,955,739 | 10/1960 | Collura . | |
| 3,656,614 | 4/1972 | Jacobson | 206/431 |
| 3,833,116 | 9/1974 | Howe | 206/431 |
| 4,546,914 | 10/1985 | Roccaforte . | |
| 4,582,199 | 4/1986 | Schuster | 206/428 |
| 4,645,072 | 2/1987 | Lemon . | |
| 4,747,487 | 5/1988 | Wood . | |
| 4,770,294 | 9/1988 | Graser . | |
| 5,167,325 | 12/1992 | Sykora . | |
| 5,328,030 | 7/1994 | Sutherland | 206/427 |
| 5,400,901 | 3/1995 | Harrelson . | |
| 5,437,364 | 8/1995 | Broskow . | |
| 5,538,130 | 7/1996 | Harrelson | 206/428 |
| 5,595,291 | 1/1997 | Negelen . | |

*Primary Examiner*—Paul T. Sewell
*Assistant Examiner*—Luan K. Bui
*Attorney, Agent, or Firm*—Larson & Larson, P.A.; Herbert W. Larson

[57] ABSTRACT

A bottle carrier including a planar bottom panel having a generally rectangular configuration. The bottom panel has opposed long side edges and short opposed end edges. The bottom panel receives a plurality of standing bottles thereon. A front and back panel is secured to the opposed long side edges of the bottom panel. The front and back panels each has lower edges foldably secured to the opposed long side edges of the bottom panel. Each of the front and back panels has a pair of end panels foldably secured to opposing end edges thereof. A pair of bottom end panels are foldably secured to the short opposed end edges of the bottom panel. A pair of top panels are foldably secured with upper edges of the front and back panels. A tape carrying handle is provided having a first end secured to a first top panel. The tape carrying handle has a second end adapted for securement to a second top panel in a carrying orientation. A second carrier tape can be secured over the first tape.

14 Claims, 6 Drawing Sheets

BOTTLE CARRIER

PRIOR APPLICATION

This application is a continuation-in-part from application Ser. No. 09/049,574, filed Mar. 27, 1998 (now abandoned).

BACKGROUND OF THE INVENTION

The present invention relates to a bottle carrier. More particularly, it pertains to carrying bottles in a paperboard carrier and preventing the bottles from falling out when the carrier is tipped.

The use of bottle carriers is known in the prior art. More specifically, carriers heretofore devised and utilized for the purpose of holding bottles are known to consist basically of familiar, expected and obvious structural configurations. Some have open tops that allow bottles to fall out when the carrier is tipped. Others have a closed top which has to be torn away before access to the bottles can be obtained.

By way of example, prior art patents relating to carriers include, U.S. Pat. No. 5,5595,291 to Negelen; U.S. Pat. No. 5,437,364 to Broskow; U.S. Pat. No. 5,400,901 to Harrelson; U.S. Pat. No. 5,167,325 to Sykora; U.S. Pat. No. 4,770,294 to Graser; and U.S. Pat. No. 4,645,072 to Lemon.

While these devices fulfill their respective, particular objective and requirements, the aforementioned patents do not describe a bottled carrier for carrying bottles and preventing the bottles from falling out when the carrier is tipped.

In this respect, the bottle beverage carrier according to the present invention substantially departs from the conventional concepts and designs of the prior art, and in doing so provides an apparatus primarily developed for the purpose of carrying bottles and preventing the bottles from falling out when the carrier is tipped while at the same time allowing machine loading and easy access to the bottles within the container.

Therefore, it can be appreciated that there exists a continuing need for a new and improved bottle carrier for carrying bottles and preventing the bottles from falling out when the carrier is tipped, but still allowing easy access to the bottles. In this regard, the present invention substantially fulfills this need.

SUMMARY OF THE INVENTION

In the view of the foregoing disadvantages inherent in the known types of carriers now present in the prior art, the present invention provides an improved bottle carrier. As such, the general purpose of the present invention, which will be described subsequently in greater detail, is to provide a new and improved bottle carrier which has all the advantages of the prior art and none of the disadvantages.

To attain this, the present invention essentially comprises a paperboard planar bottom panel having a generally rectangular configuration. A bottom panel has a pair of foldable opposed side panels and a pair of opposed front and back panels. Each front and back panel has a pair of foldable end panels and a foldable top panel. The bottom panel receives a plurality of standing bottles thereon. The pair of side panels are folded upwardly at a right angle to a short edge of the bottom panel. The front and back panels are folded upwardly at a right angle to a long edge of the bottom panel. Each of the front and back panels have the pair of end panels foldably secured to opposing end edges thereof. A first and second top panel is foldably secured with upper edges of the front and back panel respectively. A tape carrying handle is provided having a first end secured to the first top panel. The tape carrying handle has a second end adapted for securement to the second top panel in a carrying orientation.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved bottle carrier which has all the advantages of the prior art carriers and none of the disadvantages.

It is another object of the present invention to provide a new and improved bottle carrier which may be easily and efficiently manufactured and marketed.

It is a further object of the present invention to provide a new and improved bottle carrier which is of durable and reliable construction.

An even further object of the present invention is to provide a new and improved bottle carrier which is susceptible of a low cost of manufacture with regard to both materials and labor, and which accordingly is then susceptible of low prices of sale to the consuming public, thereby making such a bottle carrier economically available to the buying public.

Even still further another object of the present invention is to provide a new and improved bottle carrier for carrying bottles and preventing the bottles from falling out when the carrier is tipped.

Lastly, it is an object of the present invention to provide a new and improved bottle carrier including a planar bottom panel having a generally rectangular configuration. The bottom panel has opposed long front and back edges and short opposed end edges. The bottom panel receives a plurality of standing bottles thereon. A front and back panel is secured to the opposed lone front and back edges of the bottom panel. The front and back panels each have lower edges foldably secured to the opposed long side edges of the bottom panel. Each of the front and back panels has a pair of end panels foldably secured to opposing end edges thereof. A pair of bottom end panels are foldably secured to the short opposed end edges of the bottom panel. A pair of top panels are foldably secured with upper edges of the front and back panels. A tape carrying handle is provided having a first end secured to a first top panel. The primary carrying handle has a second end adapted for securement to a second top panel in a carrying orientation.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DESCRIPTION OF THE PREFERRED EMBODIMENT

Figure 1:
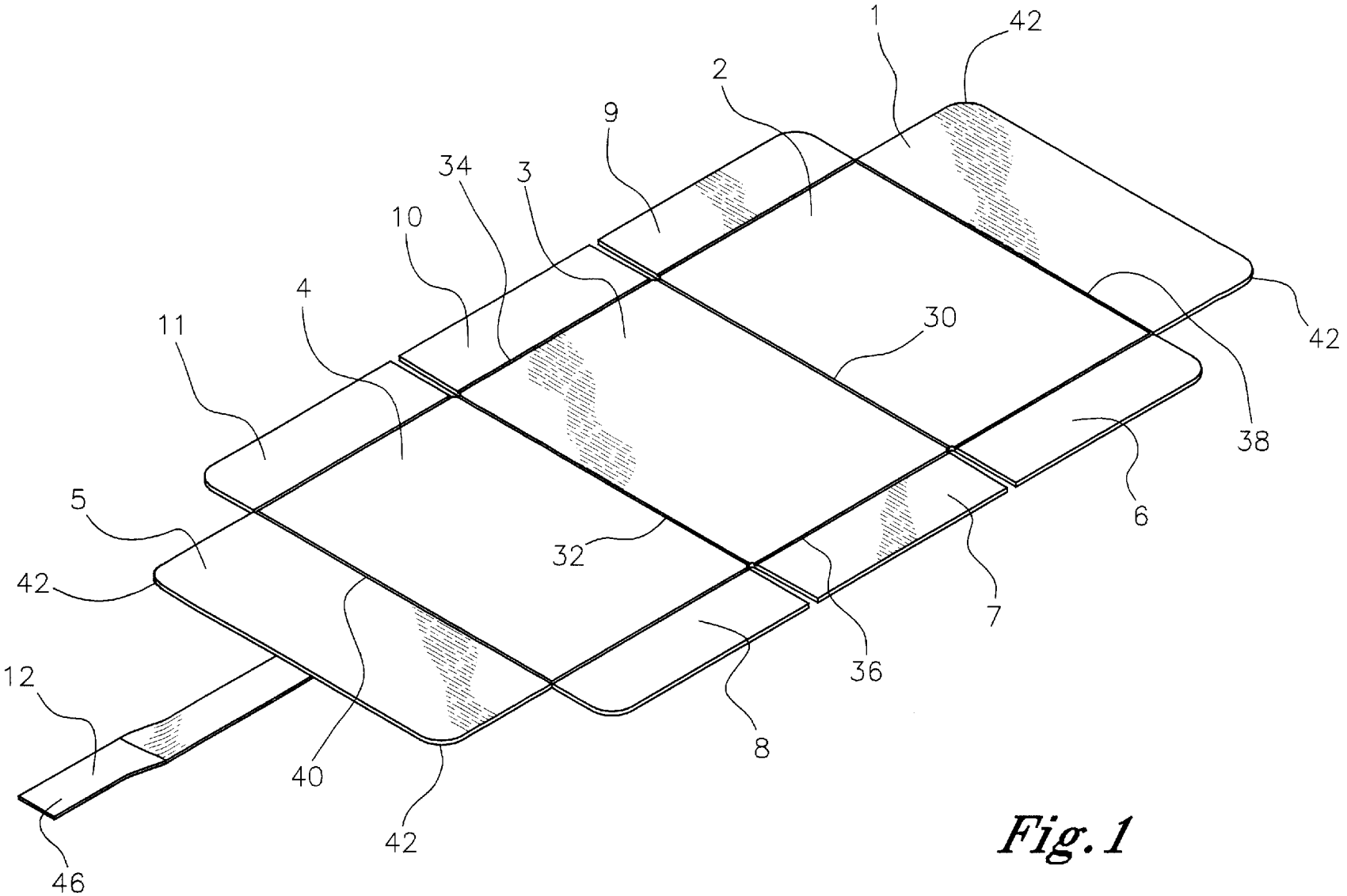
FIG. 1 is a perspective view of one embodiment of the bottle carrier constructed in accordance with the principles of the present invention.
Figure 4:
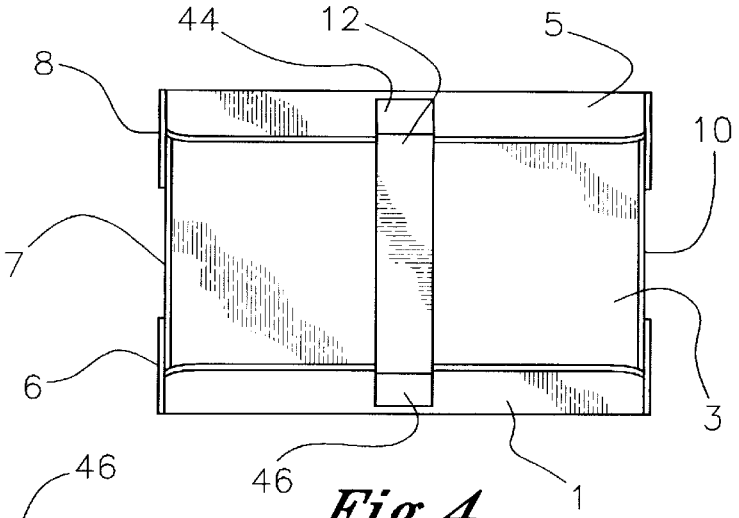
FIG. 4 is a top plan view of the present invention.
Figure 3:
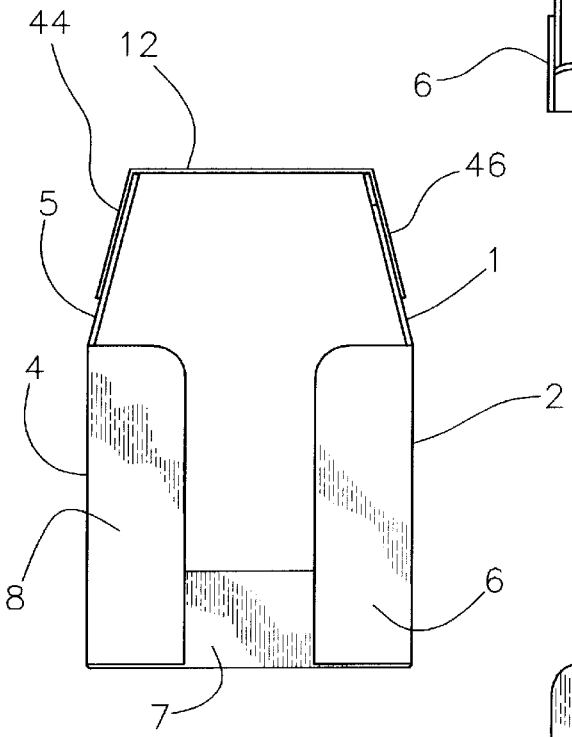
FIG. 3 is an end elevation view of the present invention.
Figure 2:
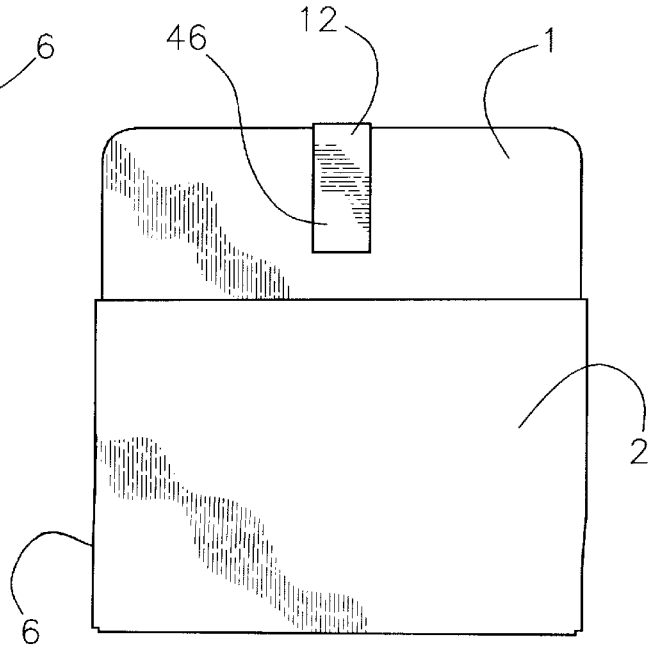
FIG. 2 is a front elevation view of the present invention.
Figure 5:
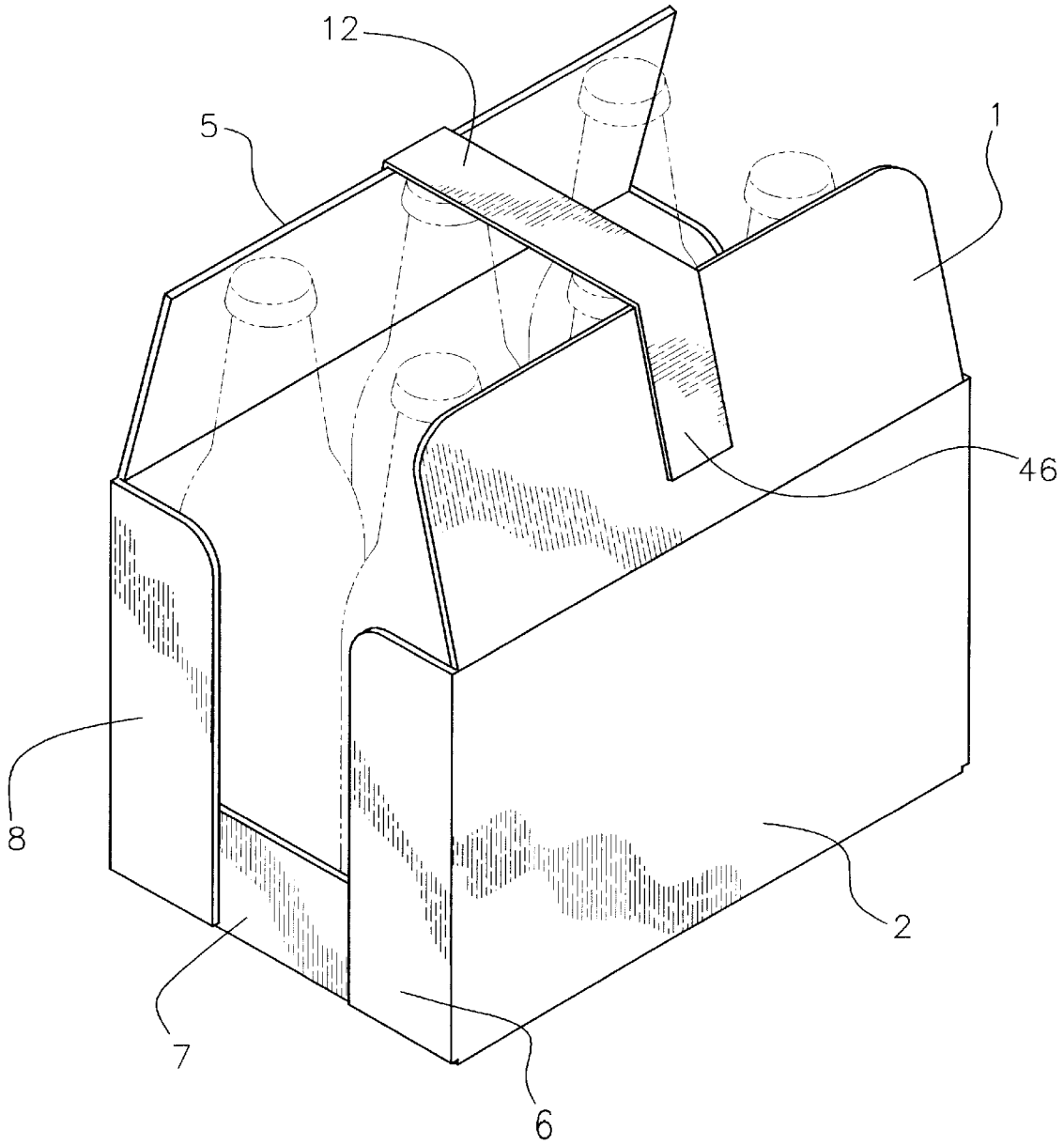
FIG. 5 is a perspective view of the bottle carrier containing bottles shown in phantom lines.

With reference now to the drawings, and in particular, to FIGS. 1 through 5 thereof, the first embodiment of the new and improved bottled beverage carrier embodying the principles and concepts of the present invention will be described.

Specifically, it will be noted in the various FIGS. that the device relates to a beverage carrier for carrying bottles and preventing the bottles from falling out when the carrier is tipped. In its broadest context, the device consists of a planar bottom panel, a front and back panel, a pair of bottom end panels, a pair of top panels, and a primary carrying handle. Such components are individually configured and correlated with respect to each other so as to attain the desired objective.

The planar bottom panel 3 has a generally rectangular configuration. The bottom panel 3 has opposed lone side edges 30 and 32 and short opposed end edges 34 and 36. The bottom panel 3 receives a plurality of standing bottles thereon.

Front panel 2 and back 4 are secured to the opposed long side edges 30 and 32 respectively of the bottom panel 3. The front and back panels 2, 4 each have lower edges foldably secured to the opposed long side edges 30 and 32 of the bottom panel 3. In use the front and back panels 2, 4 are folded upwardly to a position essentially perpendicular to the bottom panel 3. Note FIG. 2. Each of the front and back panels 2, 4 have a pair of end panels. Front panel 2 has end panels 6 and 9 foldably secured to opposing end edges thereof. In like manner, panel 4 has end panels 8 and 11 foldably secured to opposing end edges. In use, the end panels 6, 8, 9, 11 are folded inwardly to a position essentially perpendicular to the front and back panels 2, 4. See FIG. 3.

A pair of bottom end panels 7, 10 are foldably secured to the short opposed end edges 36 and 34 respectively of the bottom panel 3. In use, the bottom end panels 7, 10 are folded upwardly to a position essentially perpendicular to the bottom panel 3. The bottom end panels 7, 10 will be secured to the inwardly folded end panels 6, 8, 9, 11, preferably by an adhesive or the like. Note FIG. 3.

The pair of top panels 1, 5 are foldably secured with upper edges 38 and 40 respectively of the front and back panels 2, 4. The top panels 1, 5 each have rounded upper corners 42. In use the top panels 1, 5 are folded inwardly to a position at about a forty-five degree angle with respect to the side panels 2, 4. The top panels 1, 5 will be folded over a top end of the bottles. See FIG. 5.

The tape carrying handle 12, preferably made from polypropylene, is provided having a first end 44 secured to the top panel 5. The tape carrying handle 12 has a second end 46 for securement to the top panel 1 in a carrying orientation. Once the top panels 1, 5 are folded inwardly, the second end of the handle 12 is secured to the second top panel 1, preferably by use of an adhesive or the like. See FIG. 4.

The tape carrying handle 12 may be applied to the carrier manually, semi-automatically, or automatically by means of a carry handle applicating machine. The carrying handle thus has two purposes: (a) when applied to panels 1 and 5, it pulls the panels inward at about a forty-five degree angle so that the panels 1 and 5 are juxtaposed to the bottles, further securing the bottles in the carrier and (b) when the tape carrying handle is secured to panels 1 and 5, it functions in the carrying orientation.

Figure 7:
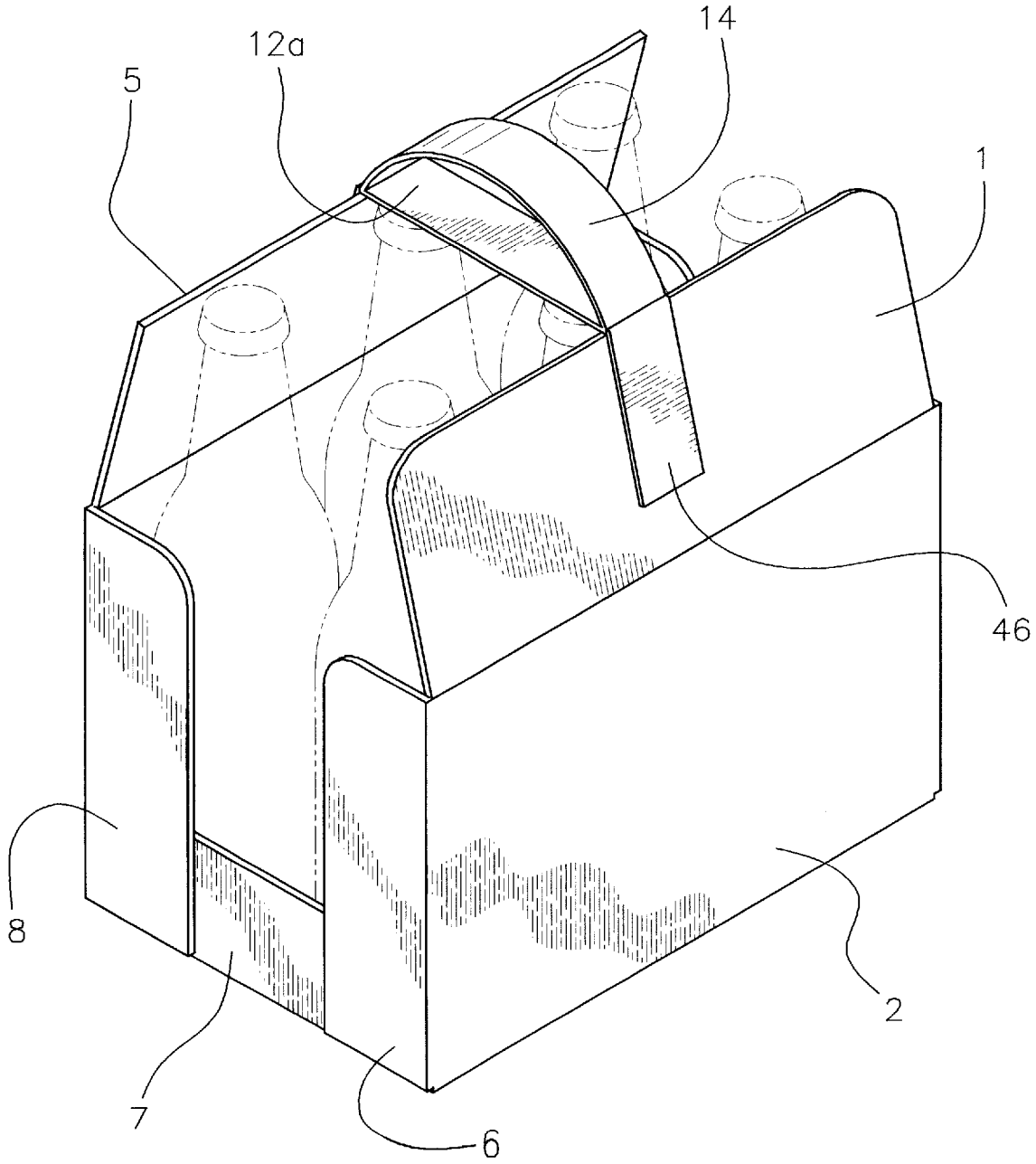
FIG. 7 is a perspective view of the bottle carrier of FIG. 5 with the addition of a second handle.

A second embodiment of the present invention is shown in FIG. 7 and includes substantially all of the components of the present invention further including a second carrying handle 14 that can be secured between the pair of top panels 1, 5 disposed over the primary carrying handle 12. A second optional carrying handle may be used to provide an easier method of carrying the device (if desired.) It also prevents the knuckles of a person carrying the bottle carrier from scraping on the bottle caps.

Figure 6:
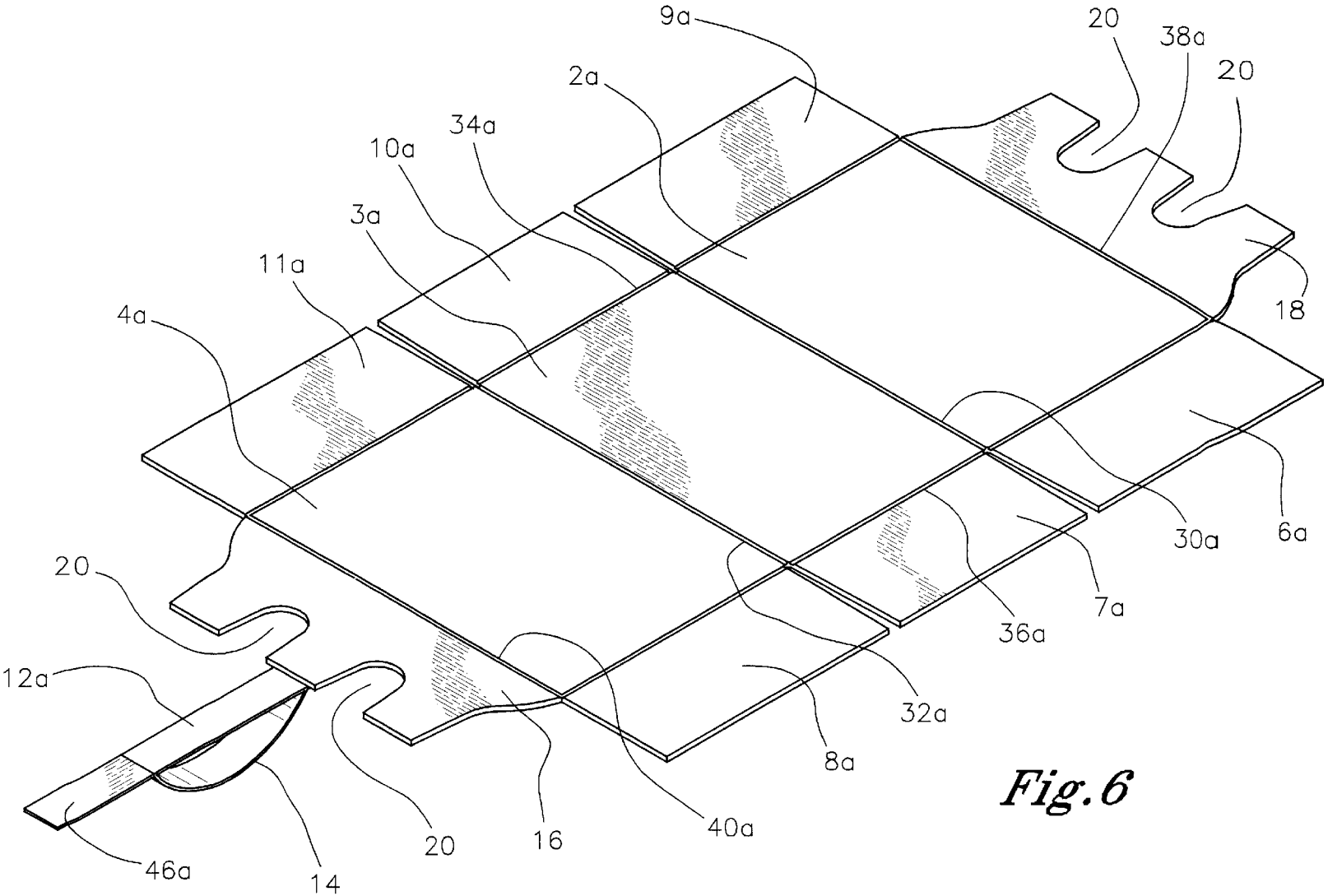
FIG. 6 is a perspective view of an alternate embodiment of a bottle carrier.
Figure 8:
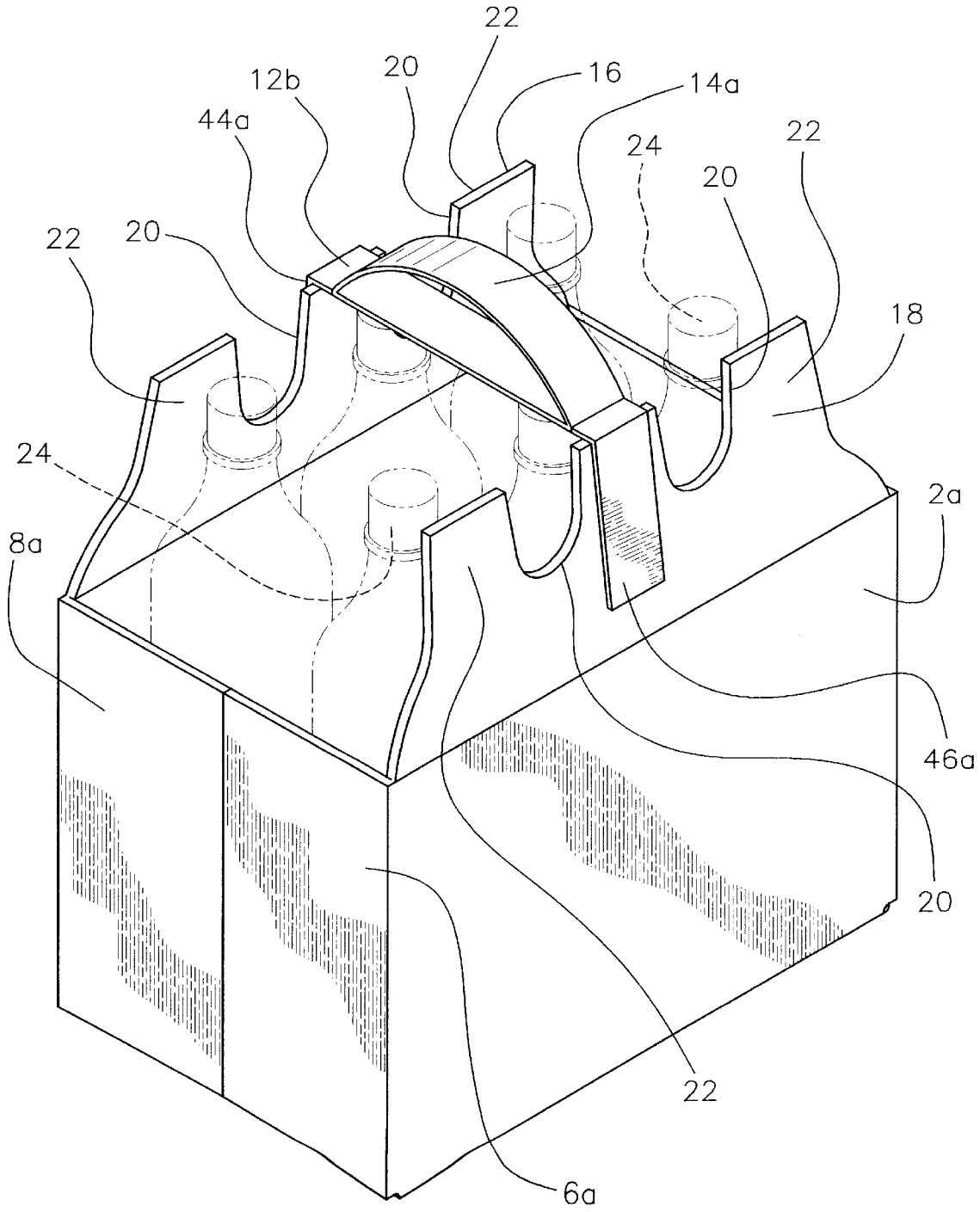
FIG. 8 is a perspective view of the alternate embodiment shown in FIG. 6, but in its completed configuration with six bottles shown in phantom lines.

Another embodiment of the invention is shown in FIGS. 6 and 8. Bottom panel 3*a* is generally rectangular in shape and receives the bottom of the bottles. Bottom panel 3*a* has opposed long edges 30*a* and 32*a* and opposed short edges 34*a* and 36*a*.

Front panel 2*a* and back panel 4*a* are secured to the opposed long edges 30*a* and 32*a* respectively. The front and back panels 2*a* and 4*a* each have lower edges foldably secured to the opposed long edges 30*a* and 32*a*. As shown in FIG. 8, the front and back panels 2*a* and 4*a* are folded upwardly to a position substantially perpendicular to the bottom panel 3*a*. Front panel 2*a* has end panels 6*a* and 9*a* foldably secured to its opposing end edges. In like manner, panel 4*a* has end panels 8*a* and 11*a* foldably secured to its opposing end edges. The end panels 6*a* and 8*a* are folded over and glued to panel 7*a*. The end panels 9*a* and 11*a* are folded over and glued to panel 10*a*.

The pair of end panels 7*a* and 10*a* are foldably secured to the short opposed end edges 36*a* and 34*a* respectively of bottom panel 3*a*. The panels 7*a* and 10*a* are folded upwardly to a position substantially perpendicular to panel 3*a*. Since panels 6*a* and 8*a* are glued over panel 7*a* and panels 9*a* and

11*a* are glued over panel 10*a*, such panels 7*a* and 10*a* are not seen in the outward appearance of the carrier of FIG. 8.

The top panels 1*a* and 5*a* are foldably secured with upper edges 38*a* and 40*a* respectively of the front and back panels 2*a* and 4*a*. Top panels 1*a* and 5*a* have cut out sections 20 forming fingers 22 that are positioned adjacent a bottle top portion 24 to prevent the bottle from moving out of the bottle carrier when the carrier is tipped. See FIG. 8.

The tape carrying handle 12*b* is preferably made from polypropylene with a first end 44*a* secured to the top panel 16 and a second end 46*a* secured to the panel 18 in a carrying orientation. Once top panels 16 and 18 are folded inwardly, the second end 46*a* is secured to panel 18 with an adhesive. A second handle 14*a* is secured between the top panels 16 and 18 disposed over handle 12*b* for the same reasons stated above for handles 12*a* and 14.

The carriers of this invention are made from paperboard and can be coated on its surfaces with a polymer to prevent wetting. Usually, six bottles are placed in each carrier but more or less can be employed depending on the weight of the bottles. In addition, indicia is printed on the front and back panels to identify the bottles being carried.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A bottle carrier for carrying bottles and preventing the bottles from falling out when the carrier is tipped comprising, in combination:

a planar bottom panel having a generally rectangular configuration, the bottom panel having opposed long side edges and short opposed end edges, the bottom panel receiving a plurality of standing bottles thereon;

a front and back panel secured to the opposed long side edges of the bottom panel, the front and back panels each having lower edges foldably secured to the opposed long side edges of the bottom panel, each of the front and back panels having a pair of end panels foldably secured to opposing end edges thereof;

a pair of bottom end panels foldably secured to the short opposed end edges of the bottom panel;

a first top panel foldably secured to an upper edge of the front panel and a second top panel foldably secured to an upper edge of the back panel; and at least one tape carrying handle having a first end secured to the first top panel, the tape carrying handle having a second end secured to the second top panel to cause the first and second top panels to bend inwardly juxtaposed to a top portion of the bottles.

2. The bottle carrier according to claim 1 and further including a second carrying handle secured between the pair of top panels disposed over the tape carrying handle.

3. The bottle carrier according to claim 1 wherein the first and second top panels have rounded edges on opposed corners distal from their attachment to the front and back panels respectively.

4. The bottle carrier according to claim 1 wherein the tape carrying handle is a polypropylene tape.

5. The bottle carrier according to claim 2 wherein the carrier handles are each a polypropylene tape.

6. The bottle carrier according to claim 1, wherein the first and second top panels each have multiple cut out slots on a top portion distal from their attachment to the front and back panels respectively.

7. The bottle carrier according to claim 1 made from paperboard.

8. The bottle carrier according to claim 6, wherein the cut out slots form fingers that bend inwardly-juxtaposed to a top portion of a bottle within the carrier.

9. A bottle carrier for carrying bottles comprising, a rectangular planar bottom panel having opposed long and short edges, the bottom panel adapted to receive multiple bottles;

a front and back panel foldably secured to the opposed long edges of the bottom panel;

the front and back panels each having a pair of end panels foldably secured to an opposing end edge;

a pair of opposed bottom end panels foldably secured to the short opposed end edges of the bottom panel;

a first top panel foldably secured along a bottom edge to an upper edge of the front panel and a second top panel foldably secured along a bottom edge to an upper edge of the back panel;

multiple cut out portions along a top edge of the first and second top panels forming fingers therebetween bent inwardly to a position juxtaposed to a top portion of the bottles; and at least one tape carrying handle having a first end secured to the first top panel and a second end secured to the second top panel to retain the first and second top panels bent inwardly towards the bottles.

10. The bottle carrier according to claim 9 wherein the tape carrying handle is a polypropylene tape.

11. The bottle carrier according to claim 9 wherein there are two cut out portions along the top edge of the first and second top panels forming three fingers.

12. The bottle carrier according to claim 9 wherein the pair of opposed bottom end panels secured to the short opposed end edges of the bottom panel are folded upwardly at about a ninety degree angle from the bottom panel and are covered by and glued to the end panels from the front and back panels.

13. The bottle carrier according to claim 9 wherein the first and second top panels are bent inwardly at about a 45° angle from the front and back panels respectively.

14. The bottle carrier according to claim 9 wherein six bottles are placed on a top surface of the bottom panel.

* * * * *